US006010373A

United States Patent [19]

Donahue

[11] Patent Number: 6,010,373

[45] Date of Patent: Jan. 4, 2000

[54] ELECTRICAL CONNECTOR INTERLOCKING APPARATUS

[75] Inventor: F. Todd Donahue, Jeffersonville, Ind.

[73] Assignee: Robinson Nugent, Inc., New Albany, Ind.

[21] Appl. No.: 08/857,657

[22] Filed: May 16, 1997

Related U.S. Application Data

[63] Continuation-in-part of application No. 08/670,643, Jun. 26, 1996.

[51] Int. Cl.[7] ..... H01R 9/22

[52] U.S. Cl. ..... 439/717; 439/701; 439/680

[58] Field of Search ..... 439/79, 80, 701, 439/680, 681, 686, 717

[56] References Cited

U.S. PATENT DOCUMENTS

| | | | |
|---|---|---|---|
| 3,042,895 | 7/1962 | Bonhomme | 439/717 |
| 4,591,228 | 5/1986 | Vasseur | 439/717 |
| 4,857,017 | 8/1989 | Erk | 439/701 |
| 4,952,172 | 8/1990 | Barkus et al. | 439/79 |
| 5,198,279 | 3/1993 | Beinhaur et al. | 439/79 |
| 5,251,106 | 10/1993 | Hui | 439/717 |
| 5,252,080 | 10/1993 | Pesson | 439/79 |
| 5,584,728 | 12/1996 | Cheng | 439/637 |
| 5,788,347 | 8/1998 | Rabinovitz | 439/717 |
| 5,839,922 | 11/1998 | Orlando et al. | 439/717 |

*Primary Examiner*—Hien Vu
*Attorney, Agent, or Firm*—Barnes & Thornburg

[57] ABSTRACT

An apparatus is provided for locking first and second adjacent electrical connector modules which are stacked end-to-end. The first and second modules each are formed to include an insulative housing surrounding a plurality of contacts and coding slots formed in a wall of the housing. The apparatus comprises a locking key having a plurality of spaced apart tabs configured to engage a plurality of coding slots in the first and second modules when the first and second modules are stacked end-to-end.

11 Claims, 10 Drawing Sheets

ELECTRICAL CONNECTOR INTERLOCKING APPARATUS

RELATED APPLICATION

This application is a continuation-in-part of application Ser. No. 08/670,643, filed Jun. 26, 1996.

BACKGROUND AND SUMMARY OF THE INVENTION

The present invention relates to an electrical connector interlocking apparatus, particularly an apparatus for providing customized connectors, built from separate modular connector components, which function like one-piece connectors. More particularly, the present invention relates to a locking key apparatus for connecting modular connector header components stacked end-to-end by engaging coding slots on the modular components.

Electronics industry requirements for electrical connector length, number of contact rows (density), and signal/power module configurations for backplane connectors continue to increase. Most connector customer requirements are application specific in terms of the I/O number and the board layout configurations. In an effort to address the multitude of "custom" customer requirements, modular connectors have been developed to permit end-to-end stacking of electrical connectors. By providing a building-block or modular connector approach, connector suppliers are able to address the multitude of custom industry application requirements while realizing economies of scale in the manufacturing process. Therefore, the modular approach is desirable from a manufacturing standpoint to reduce tooling and assembly costs associated with the manufacture of connectors having high density, very long, one-piece custom insulator bodies.

From a customer standpoint, however, a one-piece connector facilitates inventory and assembly requirements. The present invention provides a connector interlocking apparatus and method which permits the manufacturer to supply customers with a one-piece custom connector design, while allowing the manufacturer to achieve economies of scale through manufacture of smaller, standardized building block connector modules.

One type of modular connector is disclosed in U.S. Pat. No. 5,584,728 to Cheng. In the Cheng '728 patent, the connectors are each formed to including protruding wedge blocks extending upwardly above each end wall. Wedge blocks of adjacent connectors are then interconnected by fastening clips.

The present invention provides a locking key apparatus for coupling or interlocking discrete, modular, end-to-end stackable connector components into a customized one-piece connector. The current industry standard for two millimeter, two-part connectors for use with printed boards and backplanes is set forth by specification EIA-616 from the Electronic Industries Association. The international standard for such connectors is set forth in specification IEC-48B (Secretariat) 296.

According to the present invention, it is not required to modify these specified connectors to include additional non-specified components such as the protruding wedge blocks required in the Cheng '728 patent in order to interlock the connectors. The present invention uses existing structural features of the specified connectors to interlock adjacent connectors. This eliminates the need for incurring high tooling costs and manufacturing expenses typically associated with development of customized connectors or connectors that require very long, one-piece plastic insulators.

The interlocked connector of the present invention is not limited to signal or power connectors. The customer can combine both signal and power within the same integrated connector. The "mono-locked" connector system of the present invention is not limited in length or number of configurations.

The interlocking apparatus and method of the present invention locks adjacent connector modules in an X-axis and a Y-axis. The interlocking elements of the present invention rigidly contain the individual connector modules as a single locked unit. Therefore, the single unit can be handled, stored, and assembled by the customer in the same manner as a single-insulator, custom electrical connector.

According to one aspect of the present invention, an apparatus is provided for locking first and second electrical connector modules into a single unit when the modules are stacked end-to-end. The first and second modules each includes an insulative body and a plurality of electrical contacts coupled to the insulative body. The insulative body has a wall formed to include at least one slot. The apparatus of the present invention includes a locking key having a first tab configured to enter a slot in the first module to engage the first insulative body and a second tab configured to enter a slot in the second module to engage the second insulative body when the first and second modules are stacked end-to-end to couple the first and second modules together.

The slots formed in the insulative bodies of the first and second modules include a first opening portion having a first width and a second opening portion having a second width. The second width is narrower than the first width. The first and second tabs each including a shaft and a head. The shaft has a width substantially equal to the second width of the second opening portions of the coding slots.

In the illustrated embodiments, each of the heads of the first and second tabs includes a base having a width substantially equal to the first width of the first portion of the coding slots. A face of the locking key is formed to abut a face of the first module and a face of the second module when the tabs engage the first and second modules. The face of the locking key is formed to include a channel configured to surround at least one ridge formed on the face of the first module and at least one ridge formed on the face of the second module.

An illustrated locking key is formed to include a third tab configured to enter a second slot in the first module to engage the first insulative body and a fourth tab configured to enter a second slot in the second module to engage the second insulative body.

According to another aspect of the present invention, an apparatus is provided for locking first and second adjacent electrical connector modules into a single unit when the modules are stacked end-to-end. The first and second modules each include an insulative body and a plurality of electrical contacts coupled to the insulative body. The insulative body is formed to include a coding wall having at least one slot formed in the coding wall. The coding wall having an inside support surface around the slot facing toward the contacts and an outside support surface around the slot facing away from the contacts. The apparatus of the present invention includes a locking key including at least two tabs. The first tab being formed to engage a support surface of the first module and the second tab being formed to engage a support of the second module when the first and second modules are stacked end-to-end to couple the first and second modules together.

In the illustrated apparatus, the coding wall includes an outside surface facing away from the contacts. The locking key includes a front face formed to engage the outside surface, and the tabs are formed to extend through the coding slots to engage the inside support surface.

The coding wall includes an inside surface facing toward the contacts. The locking key includes a front face formed to engage the inside surface, and the tabs are formed to extend through the coding slots to engage the outside support surface. The locking key is formed to perform a coding function for at least one of the connector modules.

According to yet another aspect of the present invention, a method is provided for interlocking electrical connector modules into a single unit when the modules are stacked end-to-end. The method includes the step of providing first and second modules each including an insulative body and a plurality of electrical contacts coupled to the insulative body. The insulative body having a wall formed to include at least one slot. The method also includes the steps of providing a locking key including a first tab configured to enter a slot in the first module to engage the first insulative body and a second tab configured to enter a slot in the second module to engage the second insulative body when the first and second modules are stacked end-to--end, and inserting the locking key tabs into the slots in the first and second modules to couple the first and second modules together.

The slot includes a first opening portion having a first width and a second opening portion having a second width. The step of inserting the locking key tabs includes the steps of inserting the tabs into the first opening portion and then sliding the locking key relative to the insulative body to move the tabs into the second opening portion.

Additional objects, features, and advantages of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF DRAWINGS

As discussed above, the electronics industry connector requirements continue to expand in terms of connector length, number of contact rows (density), and signal/power module configurations. Custom requirements for connectors are application specific in terms of I/O number and board layout configurations. In an effort to address this multitude of custom connector requirements, connector manufacturers have developed connectors that permit end-to-end modular stacking of adjacent connectors. Examples of these modular, stacking connectors include METPAK2™ connectors available from Robinson Nugent, Inc., as well as Futurebus+ EIA/SP-3179 connectors, the Teradyne HDM+ connectors, and the AMP Z-Pak HM connectors.

These modular connectors permit the connector suppliers to address the many custom industry application requirements while still realizing economies as scale in the manufacturing processes. Tooling and assembly costs associated with the manufacture of high density, very long, one-piece custom insulator body backplane connectors are very high. The modular connectors permit several shorter connectors to be stacked end-to-end to form the larger connector.

Customers, however, still prefer a "one-piece" connector to facilitate inventory and assembly. The interlocking apparatus and method of the present invention permits modular connectors to be interlocked in a desired configuration and shipped to the customers as a single piece unit. However, since the connector of the present invention is still made up of modular parts, the connector manufacturer can achieve economies as scale through manufacture of standardized building-block modules.

The apparatus and method of the present invention permits reliable interlocking of discrete, modular, end-to-end stackable, connector components so that a customer can be supplied with a customized connector which functions as a one-piece connector. The interlocking system of the present invention eliminates the need for incurring high tooling costs and manufacturing expenses typically associated with production of customized backplane connectors that use very long, high density, one-piece plastic insulators.

Figure 1:
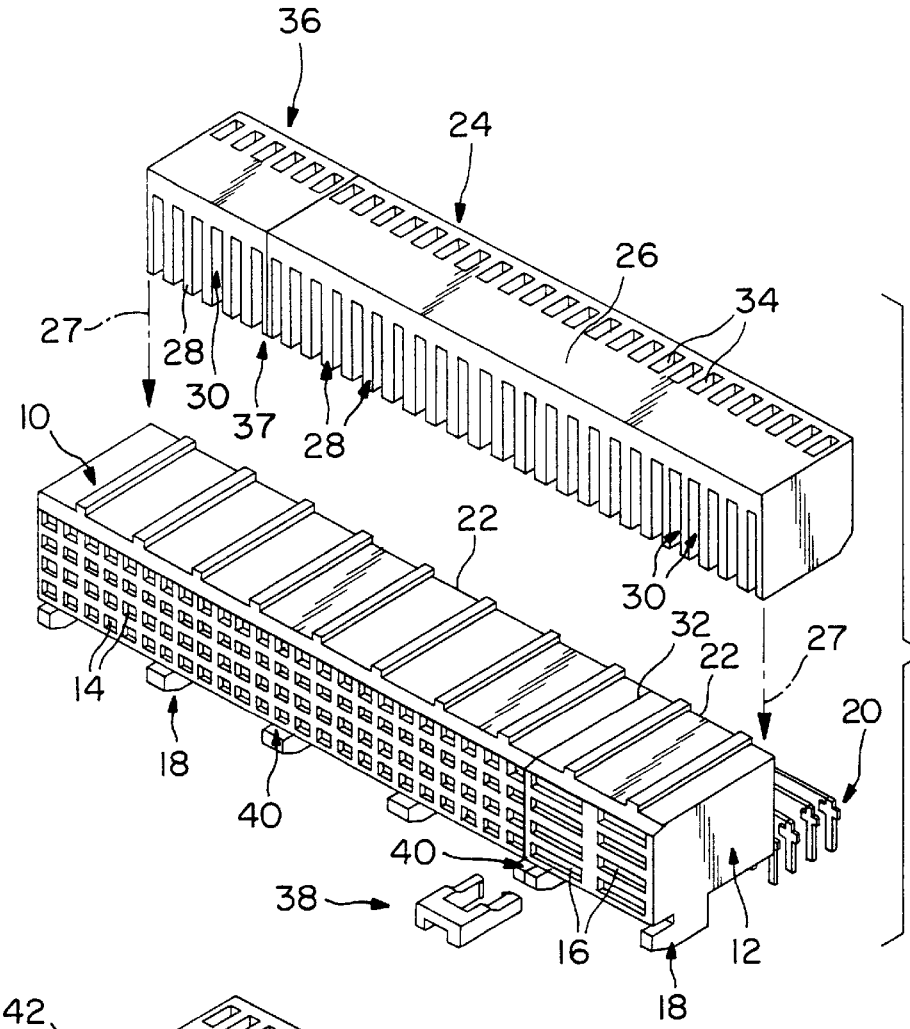
FIG. 1 is an exploded perspective view of an electrical connector interlocking apparatus of the present invention including a cap for insertion over contact terminals of the connector and a locking clip for coupling feet of adjacent connector modules together to form an interlocked connector which simulates a one-piece, custom connector.
Figure 19:
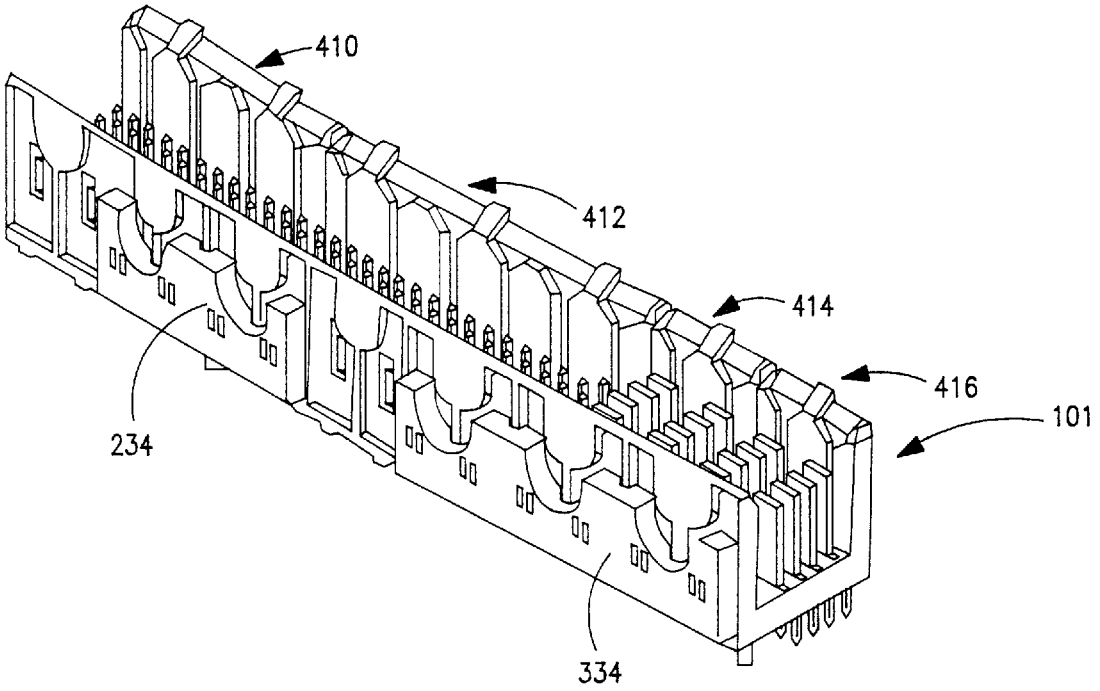
FIG. 19 is a perspective view showing header modules interlocked by the locking key embodiments shown in FIGS. 17 and 18.

Referring now to FIG. 1, an interlocking apparatus of the present invention is designed to connect a first electrical connector module 10 to an adjacent second connector module 12. The first connector module 10 includes a plurality of connector windows 14 for receiving pins of a header connector 101 (FIG. 19). Connector module 12 also includes a plurality of connector windows 16.

Connector modules 10 and 12 include insulative feet 18 which are formed integrally with the connector bodies. The feet 18 adjacent opposite ends of the modules 10 and 12 have a thickness which is about half the thickness of the remaining feet 18. Electrical contacts are located within connector modules 10 and 12 in a conventional manner for receiving the male pins of the header connector 101 (FIG. 19) which extend through windows 14 and 16. Contact terminals 20 extend from a rear wall 22 of connector modules 10 and 12. The terminals 20 are configured to be connected to conductive pads or to be conductive through holes on a printed circuit board to provide an electrical connection between the contact terminals 20 and the printed circuit board.

Figure 2:
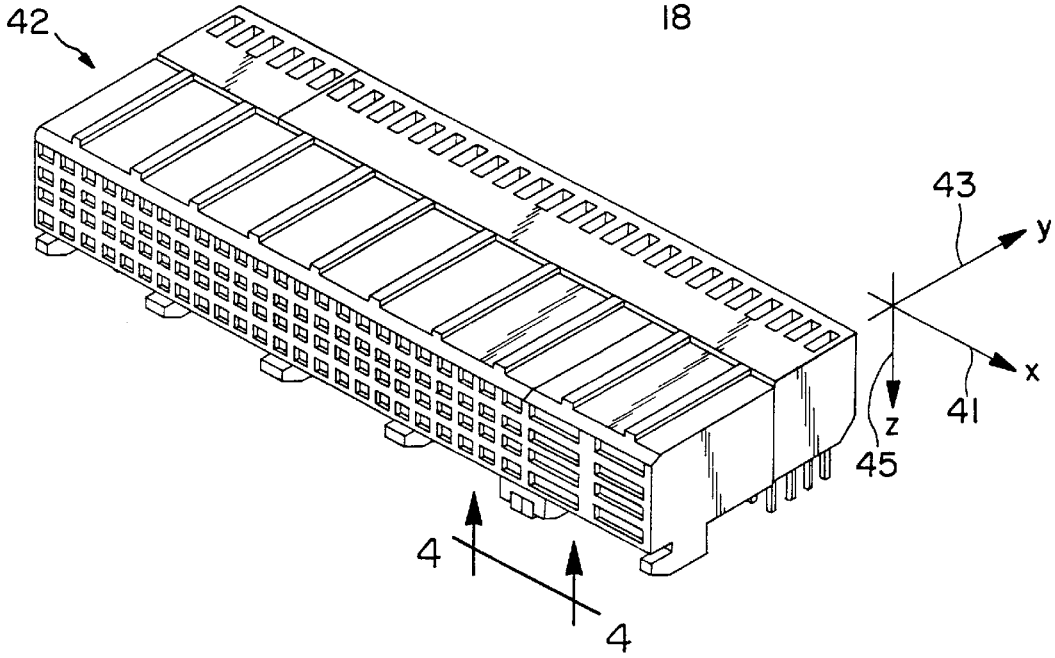
FIG. 2 is a perspective view of the assembled connector modules, caps, and clip of FIG. 1.

An interlocking apparatus of the present invention includes an interlocking cap 24 having an insulative housing 26 which is formed to include a plurality of downwardly extending divider walls 28. The divider walls 28 are spaced apart to define slots 30. The cap 24 is configured to be installed downwardly in the direction of arrows 27 over the outwardly extending contact terminals 20 until the cap is seated as illustrated in FIG. 2. Contact terminals are aligned in a plurality of rows. Each row of contact terminals 20 is configured to enter a separate slot 30 formed between divider walls 28 of cap 24. As illustrated in FIGS. 1 and 2, cap 24 is configured to span across an interconnection joint 32 between adjacent connector modules 10 and 12 to retain the modules 10 and 12 together. Openings 34 are formed in a top surface of housing 26.

In the embodiment illustrated in FIGS. 1 and 2, a second cap 36 having a length equal to the length of module 12 is located at an end of module 10. The end walls 37 of adjacent caps 24 and 36 have a thickness which is one-half the thickness of the divider walls 28. Therefore, the caps 24 and 36 are end-to-end stackable. In another embodiment, the cap can have a length equal to the entire length of both module 10 and module 12.

The present invention also includes a locking clip 38 configured to be inserted into a coding slot 40 between adjacent feet 18 of connector modules 10 and 12. The coding slots 40 are known for receiving various coding systems which are known in the art. Details of locking clip 38 are discussed below with reference to FIGS. 3–5.

Once the caps 24 and 36 and the clip 38 are in position on the modules 10 and 12, the modules 10 and 12 function as a single interlocked or one-piece connector. Therefore, a customer can store the interlocked connector 42 illustrated in FIG. 2 as a unit to facilitate the assembly process and to facilitate inventory.

Figure 3:
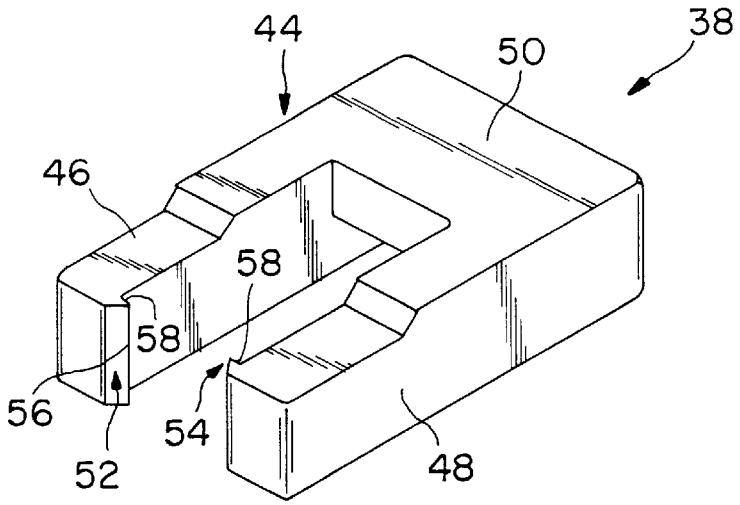
FIG. 3 is an enlarged perspective view of the locking clip of the present invention.
Figure 4:
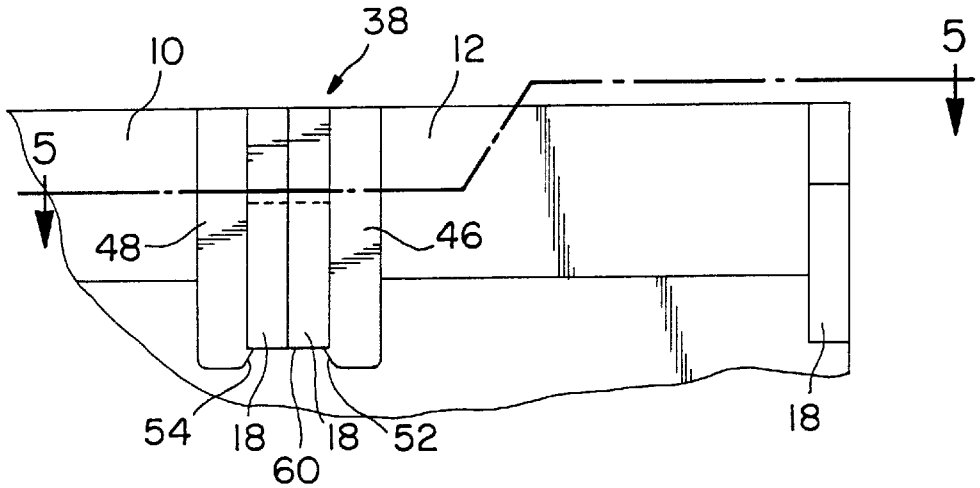
FIG. 4 is a partial bottom view taken along lines 4—4 of FIG. 2 illustrating engagement of the clip with the feet on adjacent connector modules.
Figure 5:
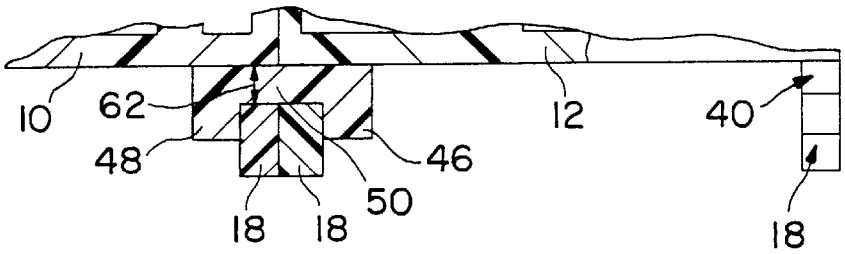
FIG. 5 is a sectional view taken along lines 5—5 of FIG. 4 further illustrating the locking clip and feet of the adjacent connector modules.

The clip 38 of the present invention is best illustrated in FIGS. 3–5. As illustrated in FIG. 3, clip 38 includes an insulative body 44 having first and second spring arms 46 and 48 extending outwardly from a web portion 50. Spring arms 46 and 49 include inwardly projecting barbs 52 and 54, respectively, adjacent distal ends spaced apart from the web portion 50. Barbs 52 and 54 each include a leading ramp surface 56 and a trailing flat surface 58 which extends generally perpendicular to spring beams 46 and 48.

The U-shaped locking clip 38 is inserted over feet 18 of adjacent modules 10 and 12. In the illustrated embodiment, spring beam 46 of clip 38 is adjacent foot 18 of connector module 12, and spring arm 48 of clip 38 is adjacent foot 18 of connector module 10. The ramp sections 56 of barbs 52 and 54 facilitate insertion of the clip 38 over the feet. If the barbs 52 and 54 engage a portion of the feet 18, the ramp surfaces 56 help the spring arms 46 and 48 expand outwardly to permit insertion of the clip 38 over the feet 18. Once the clip 38 is fully inserted as illustrated in FIG. 4, the trailing surfaces 58 of spring arms 46 and 48 engage a rear edge 60 of feet 18 to hold the clip 38 in place between the adjacent modules 10 and 12.

As best illustrated in FIG. 5, the web section 50 has a thickness illustrated by dimension 62 which is substantially equal to a thickness of the code key slots 40. As illustrated in FIGS. 1 and 2, the interlocked connector modules 10 and 12 are not limited to signal or power connectors. The customer can combine both signal and power modules within the same integrated connector. In addition, the interlocked connectors are not limited to only two modules. Any number of modules can be interconnected using the cap 24 and clip 38 of the present invention as illustrated in FIG. 6.

The divider walls 28 and slots 30 which receive contact terminals 20 of modules 10 and 12 are configured to lock the contact terminals 12 of the adjacent modules 10 and 12 together. Therefore, the caps 24 and 36 hold the modules rigid along the X-axis 41 illustrated in FIG. 2. The locking clip 38 holds the adjacent modules 10 and 12 together in the Y-axis 43 of FIG. 2 due to the engagement of spring arms 46 and 48 along with the engagement of trailing surfaces 58 with the surfaces 60 of the feet 18 of adjacent modules 10 and 12. In addition, since the thickness 62 of web section 50 is substantially equal to the thickness of the adjacent coding slots 40, clip 38 also locks the adjacent modules 10 and 12 along the Z-axis 45 of FIG. 2. Since the connector illustrated in FIG. 2 is locked in all three directions, a customer can inventory and assemble mono-locked connector of FIG. 2 in an identical manner as the customer would normally order a single-insulator, one-piece customer connector. The caps 24 and 36 also align the contact terminals 20 along a common centerline in the X-axis 41 and the Y-axis 43.

Figure 6:
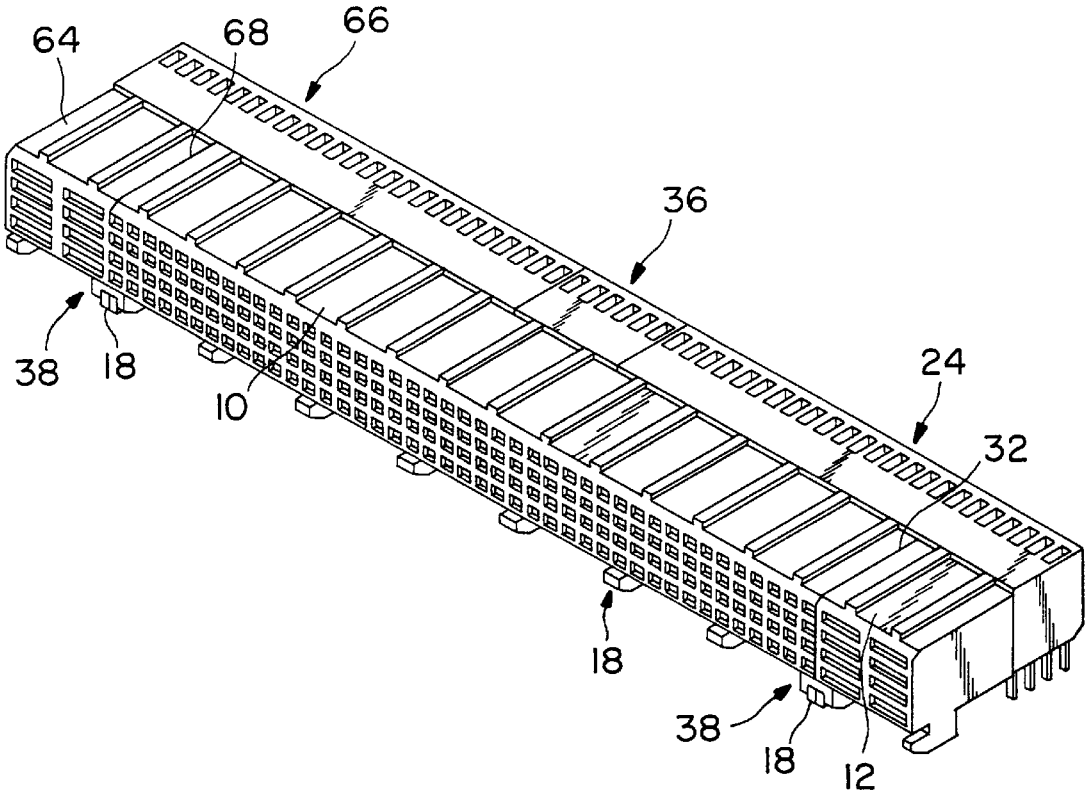
FIG. 6 is a perspective view of another embodiment of the present invention in which three separate connector modules are interconnected using the caps and clips of the present invention.

FIG. 6 illustrates another embodiment of the present invention in which more than two modules are interconnected. Specifically, another module 64 has been added to the opposite end of connector module 10 to provide an even longer locked connector. In this embodiment, a cap 66 overlaps abutting ends 68 of module 10 and module 64. Another clip 38 is used to lock the feet 18 of the abutting ends 68 of modules 10 and 64.

Figure 7:
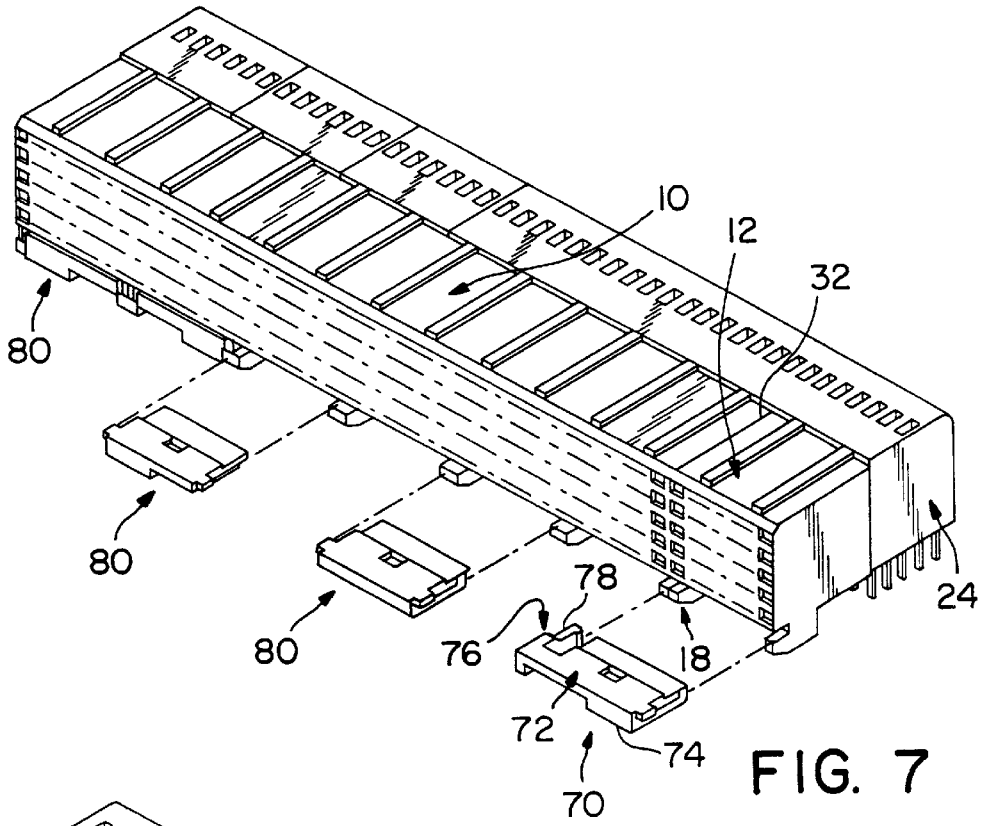
FIG. 7 is a perspective view of another embodiment of the present invention in which the clip of the present invention has been integrated with a code key.

Yet another embodiment of the present invention is illustrated in FIG. 7. In this embodiment, the clip 38 has been integrated with a conventional code key to form an improved code key 70. Code key 70 includes a body 72 which has a standard coding section 74 configured to mate with a complementary coding section located on the header connector 101 (FIG. 19). In the improved code key 70 of the present invention also includes a clip 76. Clip 76 functions in a manner similar to clip 38 of FIGS. 1–6. Clip 76 includes a spring arm 78 having a barbed end similar to barb 54.

When the improved code key 70 is installed on the module 12, the clip 76 interlocks the adjacent feet 18 of modules 10 and 12 in a manner discussed above. Other conventional code keys 80 can be used with the interlocked connector illustrated in FIG. 7. The interlocking caps 24 and 36 are also used to interlock the modules 10 and 12 in FIG. 7 as discussed above.

Figure 8:
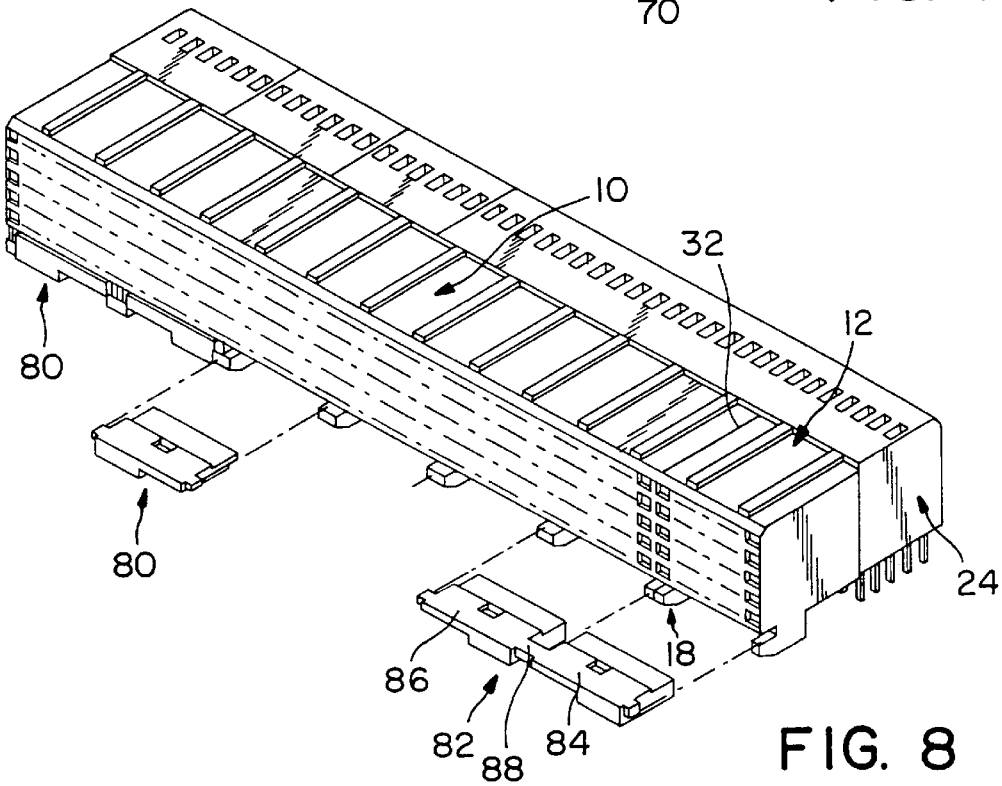
FIG. 8 is a perspective view of yet another embodiment of the present invention in which the clip of the present invention is formed between two interconnected code keys.

Still another embodiment of the present invention is illustrated in FIG. 8. In this embodiment, a dual code key apparatus 82 includes a first code key body 84 integrally formed with a second code key body 86. An interconnecting web portion 88 is formed between code key body 84 and code key body 86 to provide a clip for interlocking feet 18 of adjacent connector modules 10 and 12 as discussed above with reference to clip 38. The web portion 88 has substantially the same thickness as the coding slot 40 of feet 18 as discussed above.

The improved code keys 70 and 82 illustrated in FIGS. 7 and 8, respectively, permit the formation of an interlocked connector that functions as a one-piece connector. The interlocked connectors provide coding capabilities for customers that require coding keys between the backplane connectors 10 and 12 and the header connectors (FIG. 1).

FIGS. 9–15 illustrate another embodiment of the electrical connector interlocking apparatus of the present invention. A header locking key 108 of the present invention is designed to connect a first electrical header module 110 to an adjacent second header module 112. First header module 110 includes a plurality of connector pins 114 and second header module 112 includes a plurality of connector pins 116. Connector pins 114, 116 are received by the corresponding connector windows 14 of connector module 10 and connector windows 16, of connector module 12, respectively, as shown in FIG. 1. Illustratively, pins 114 are signal pins and pins 116 are power pins. The present invention permits various desired combinations of signal pins 114 and power pins 116 to be interlocked within the same integrated connector assembly. The present invention also permits modules with all signal pins or all power pins to be interlocked to form connectors of increased length or density.

The current industry standard for two millimeter, two-part connectors for use with printed boards and backplanes is set forth by specification EIA-616 from the Electronic Industries Association, The international standard for such connectors is set forth in specification IEC-48B (Secretariat) 296. It is not required to modify these specified connectors to include additional nonspecified components such as wedge blocks required in U.S. Pat. No. 5,584,728 to Cheng in order to interlock the adjacent connectors in accordance with the present invention.

Connector header modules 110, 112 are each formed with an insulative housing 118 that has first and second ends 120, 122, a back side wall 124 and a coding side wall 126. Coding side wall 126 is formed with a coding face 128 facing inwardly towards the connector pins 114, 116, and an outside face 130. In the embodiment shown in FIG. 9, header modules 110, 112 each are formed with two coding slots 132 in the coding side wall 126.

Figure 9:
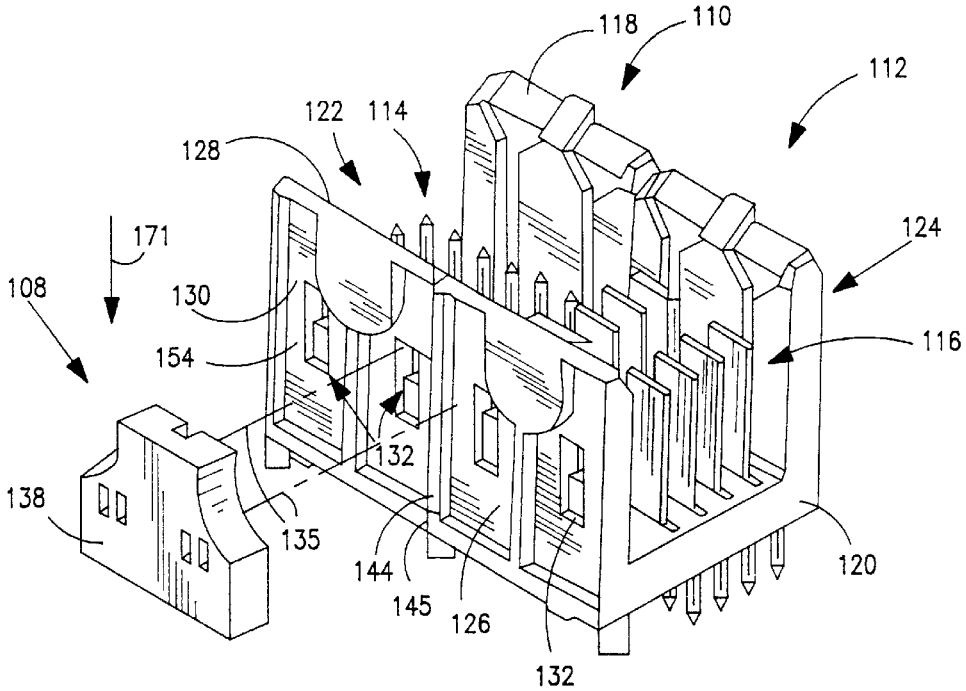
FIG. 9 is a perspective view of another embodiment of the present invention in which two header modules are coupled together by a locking key configured to engage coding slots of the header modules.
Figure 10:
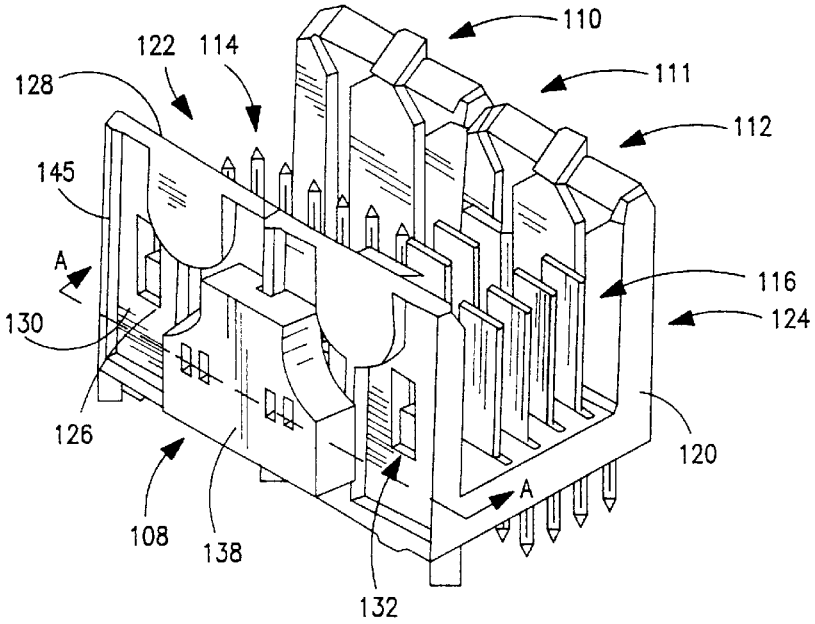
FIG. 10 is a perspective view showing the components of FIG. 9 with the locking key engaged in the coding slots of the header modules.
Figure 11:
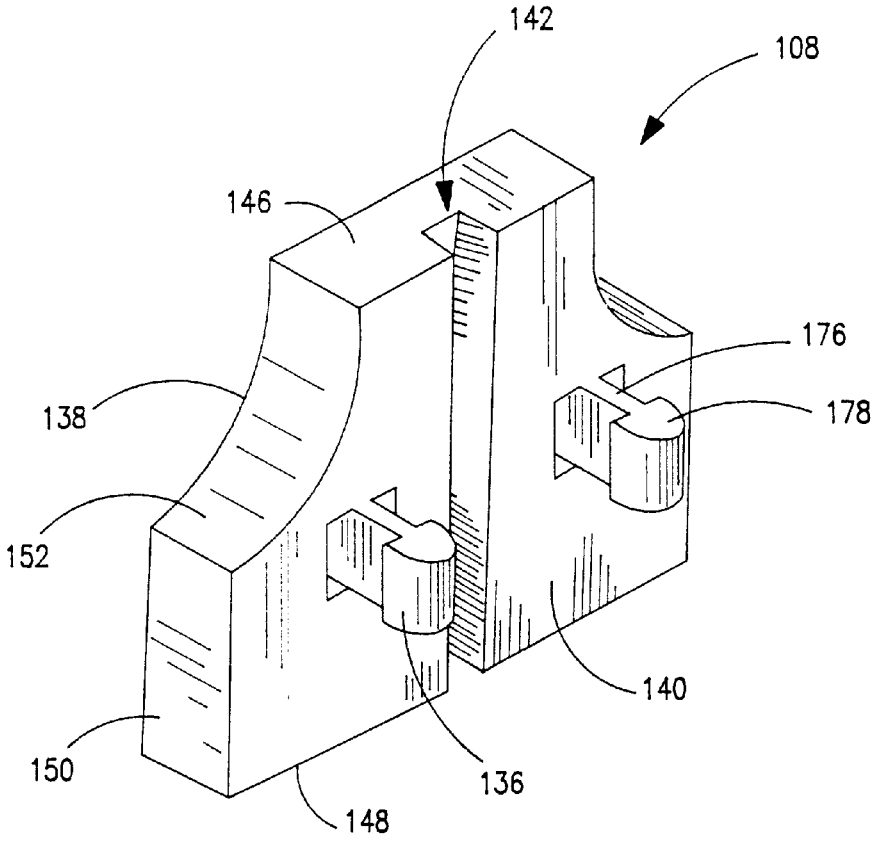
FIG. 11 is an enlarged perspective view of the locking key showing locking key tabs and a channel for engaging a ridge in the header modules.

Locking key 108 is illustratively formed with two locking tabs 136 as best shown in FIGS. 11–14. Dashed lines 135 in FIG. 9 show where locking tabs 136 are installed into coding slots 132 of first and second header modules 112, 114 to create a "mono-locked" header module 111 as shown in FIG. 10. Thus configured, the "mono-locked" header module 111 can be effectively treated as a single unit for purposes of installation, inventory, shipping, billing and the like.

FIGS. 11–15 illustrate the structural details of locking key 108 shown in FIGS. 9 and 10. When first and second header modules 110, 112 are stacked end-to-end, two coding side wall end ridges 145 abut to form a coding side wall outside ridge 144 of the combined modules. Locking key 108 has an outside face 138 and an inside face 140. The inside face 140 is formed to include locking tabs 136 that extend generally perpendicularly away from inside face 140. The inside face 140 of locking key 108 is further formed to include a channel 142 in that is shaped to receive ridge 144 of the end-to-end stacked modules 110, 112.

Figure 16:
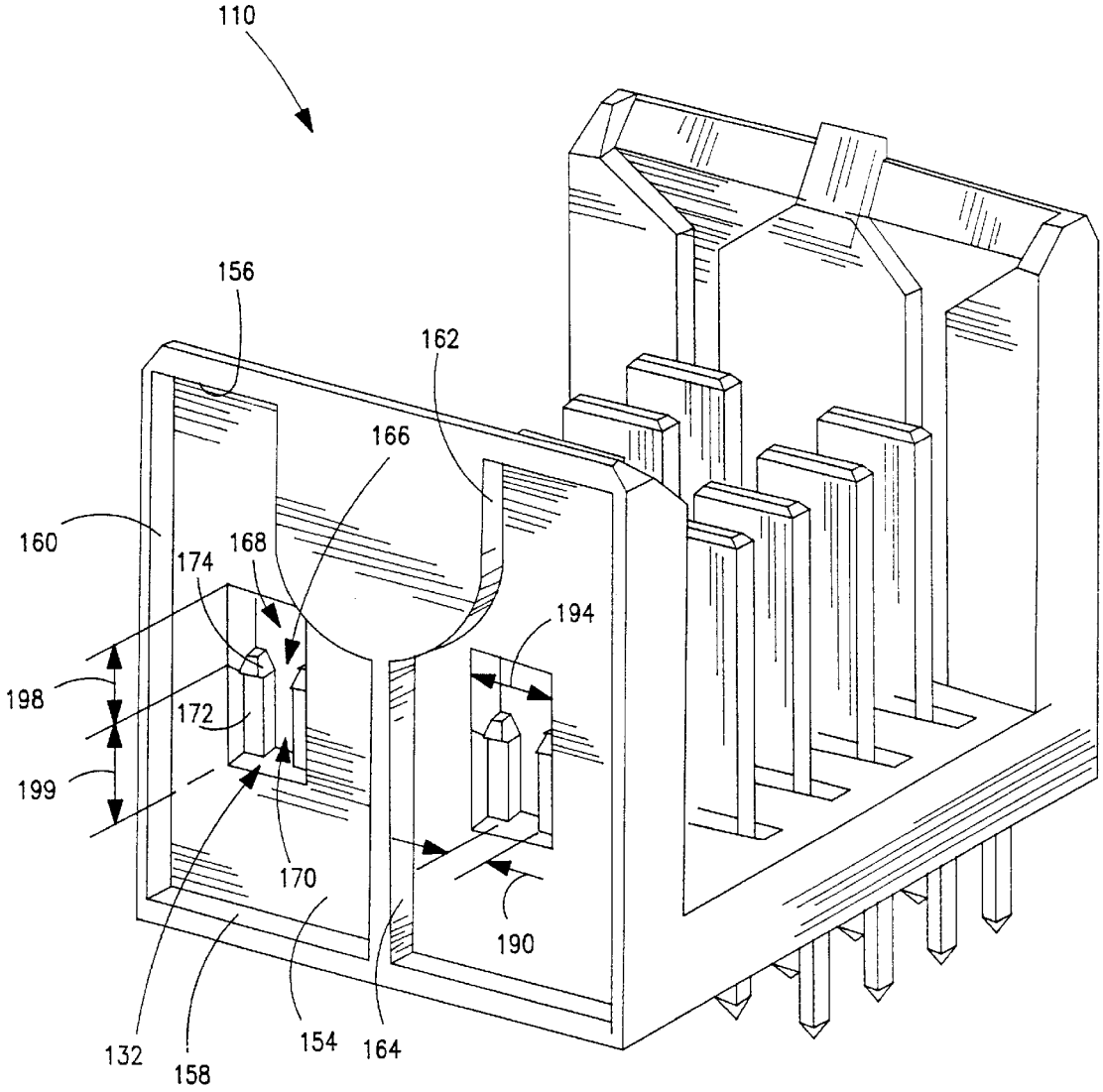
FIG. 16 is an enlarged perspective view of a header module showing details of the coding slots.

Locking key 108 is further formed to include a top side wall 146, a bottom side wall 148, straight side wall portions 150, and curved side wall portions 152. Locking key channel 142 and side walls 146–152 are formed so that locking key inside face 140 engages a recessed depression area 154 formed in the outside surfaces 130 of header modules 110, 112 when locking key tabs 136 are inserted into coding slots 132. Depression area 154 is defined by depression area top wall 156, bottom wall 158, straight side wall 160, curved side wall 162, and short side wall 164 as shown in FIG. 16. When the locking key inside face 140 engages the coding wall outside surface depression area 154, locking key channel 142 receives the coding side wall outside ridges 144.

Referring now to FIG. 16, header module coding slots 132 are formed with a rectangular outer opening 166 that is divided by coding slot tabs 172 into a first rectangular top opening portion 168 and a second, smaller rectangular opening portion 170. Coding slot tabs 172 are formed with top bevels 174 that facilitate alignment of locking key tabs 136 when locking key tabs slide from top opening portion 168 to bottom opening portion 170 as discussed below.

Figure 12:
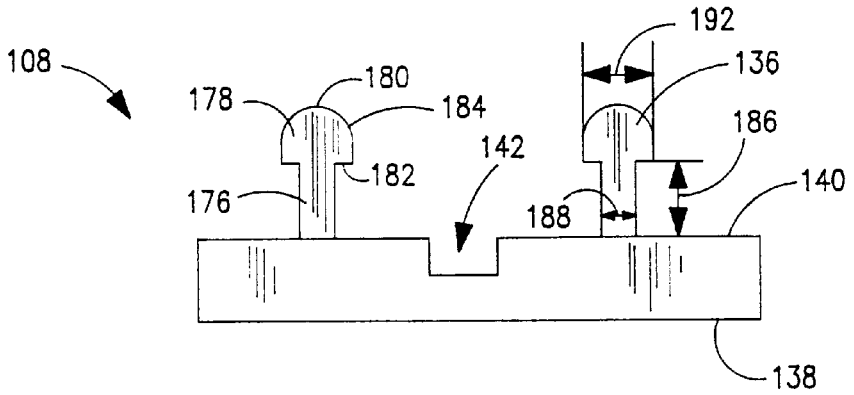
FIG. 12 is a rear elevation view of the locking key of FIGS. 9–11.
Figure 14:
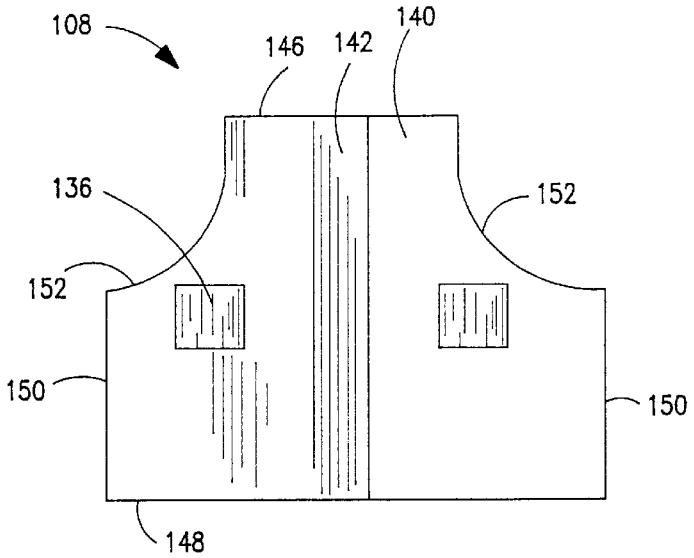
FIG. 14 is a plan view of the locking key of FIGS. 9–13.
Figure 13:
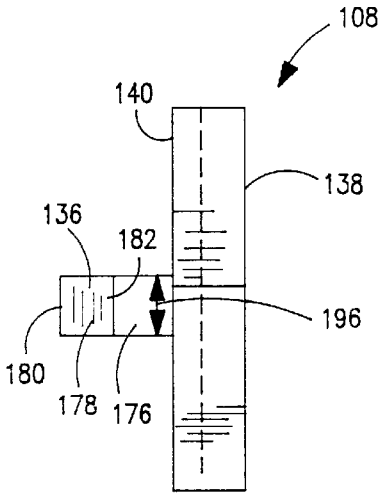
FIG. 13 is a side elevation view of the locking key of FIGS. 9–12.
Figure 15:
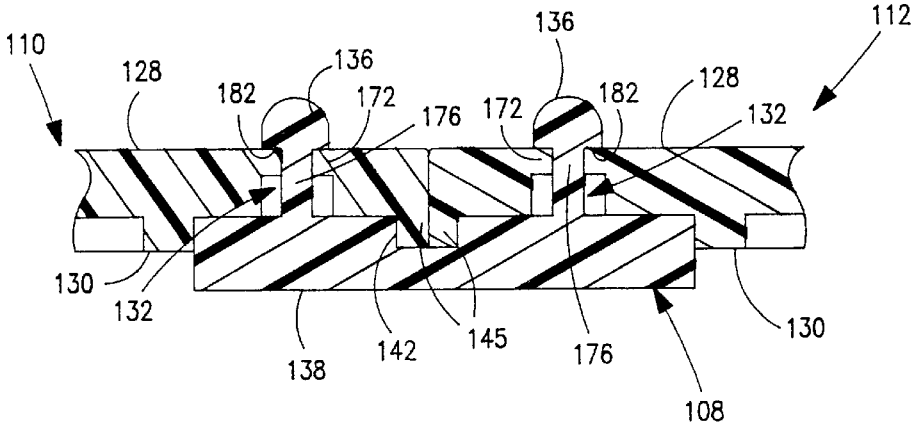
FIG. 15 is a sectional view along line A—A of FIG. 10 showing tabs of a locking key installed in coding slots of two header modules.

Locking key tabs 136 are each formed with a shaft 176 and a head 178 as shown in FIGS. 11–15. Tab head 178 is formed with bottom walls 182 and a top 180. In the illustrated embodiment, top 180 is connected to bottom side walls 182 by arcuate side walls 184, resulting in tab head 178 having a generally hemispherical cross-section, with top side 180 being the apex of the hemisphere as shown in FIGS. 12 and 15. The shape of the tab heads 178 facilitates insertion of tabs 136 into coding slot top opening portions 168.

Tab shafts 176 have a height 186 approximately equal to the thickness of the header module coding side wall 126 between the coding face 128 and the coding wall outside face depression area 154 and tab shafts 176 have a width 188 approximately equal to the width 190 of coding slot bottom opening 170. Tab heads 178 have a bottom width 192 slightly less than a width 194 of coding slot top opening 168. Locking key tabs 136 further have a length 196 which is less than the height 198 of coding slot top opening portion 168.

Locking key 108 as shown in FIGS. 9–15 installs into coding slots 132 of first and second header modules 110, 112 as follows. Locking key 108 is oriented with inside face 140 facing header module coding wall outside faces 130 and with tab heads 178 aligned with coding slot top opening portions 168 of adjacent header modules 110, 112. Locking key 108 is then inserted towards header modules 110, 112 so that tab heads 178 pass through coding slot top opening portions 168 until locking key inside face 140 abuts depressions 154 in the coding wall outside faces 130 of header modules 110, 112. Header module coding wall end ridges 145 are surrounded by locking key channel 142 of locking key 108. Locking key 108 is then moved in the direction of arrow 171 as shown in FIG. 9 to the locked position as shown in FIG. 10. In the locked position, the tabs 136 have moved from the top opening portions 168 of coding slots 132 into the bottom opening portions 170 and bottom walls 182 of tab heads 136 engage inside coding face 128 of header module coding walls 126 as best shown in FIG. 15. Thus configured, header module locking keys 134 restrain first header module 110 from movement relative to second header module 112.

Figure 17:
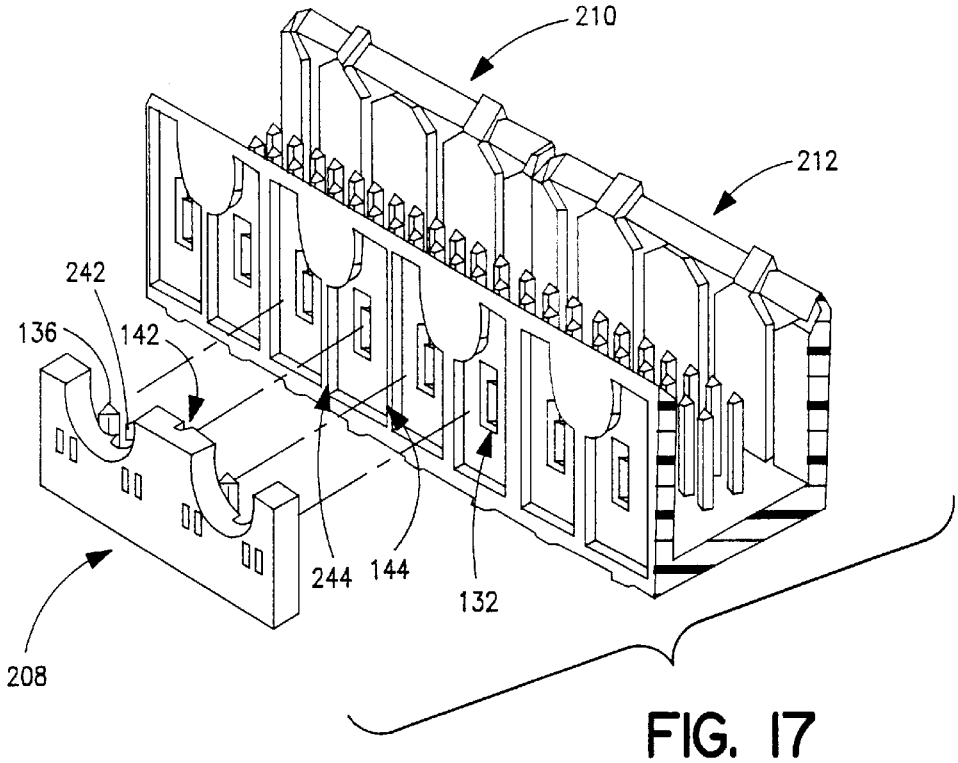
FIG. 17 is a perspective view showing a locking key embodiment of the present invention having four tabs for engaging two coding slots on a first header modules and two coding slots on a second header module.

Another embodiment of a locking key 208 having four tabs 136 is shown in FIG. 17. The four-tab locking key 208 operates in a similar manner to the two-tab locking key 108 in that it engages coding slots 132 and end ridges 145 of the end-to-end stacked modules 210, 212. In addition to engaging a second coding slot 132 in each of modules 210, 212, locking key 234 has channels 242 for engaging a second ridge 244 on each of the modules to further secure the modules from relative movement.

Figure 18:
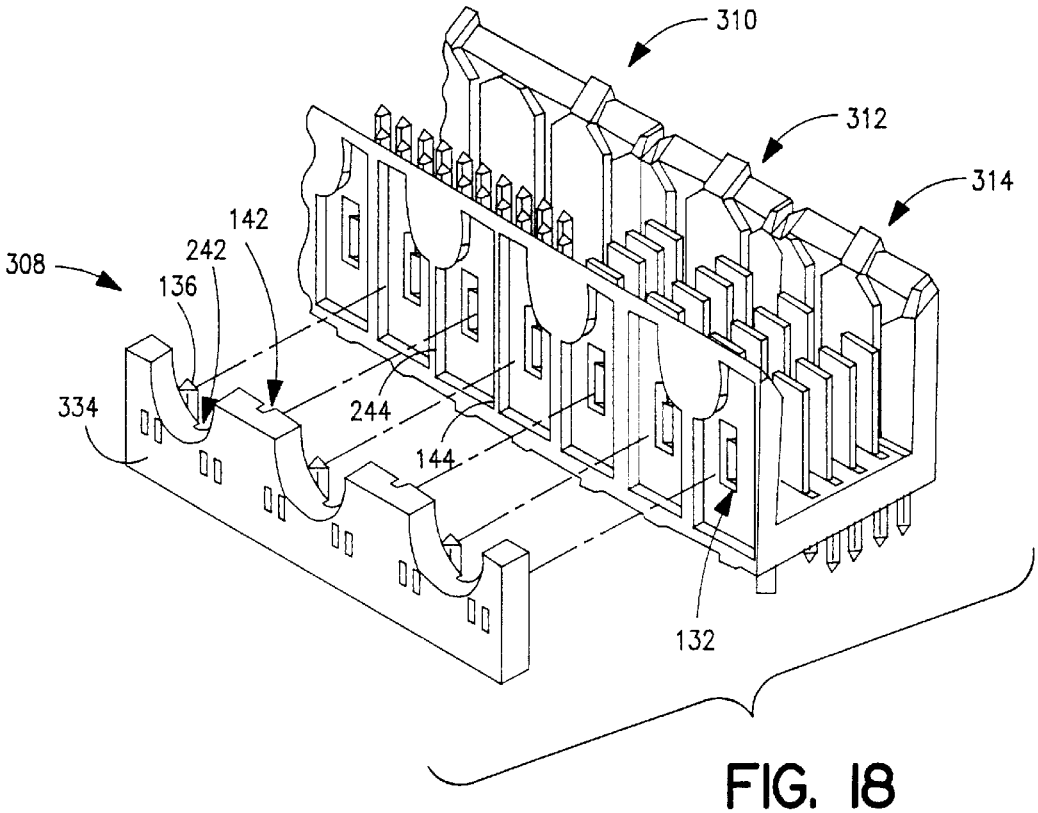
FIG. 18 is a perspective view showing a locking key embodiment of the present invention having six tabs for engaging two coding slots on each of three header modules.

Yet another embodiment of the present invention is a locking key 308 having six tabs 136 as shown in FIG. 18. The six-tab locking key 108 can interlock three header modules 310, 312, 314 stacked end-to-end. Locking key 308 engages coding slots 132 and has channels 142, 242 to engage ridges 144, 244 in the same fashion as the four-tab locking key 208. FIG. 19 illustrates a mono-locked header module 101 assembled from four header module components 410, 412, 414, 416 stacked end-to-end and interlocked by a four-tab locking key 208 and a six-tab locking key 308.

Although the invention has been described in detail with reference to certain preferred embodiments, variations and modifications exist within the scope and spirit of the present invention as described and defined in the following claims.

What is claimed is:

1. An electrical connector apparatus comprising:

first and second electrical connector modules configured to be coupled together to form a single unit when the first and second electrical connector modules are stacked end-to-end, the first and second electrical connector modules each including an insulative body and a plurality of electrical contacts coupled to the insulative body, the insulative body of each of the first and second electrical connector modules having a wall formed to include at least one slot, each slot including a first opening portion having a first width and a second opening portion having a second width, the second width being narrower, than the first width, and a locking key including a first tab configured to enter the slot formed in the first electrical connector electrical connector module and a second tab configured to enter the slot formed in the second electrical connector module when the first and second electrical connector modules are stacked end-to-end, the first and second tabs each including a shaft and a head, the shaft having a width less than the second width and the head having a width larger than the second width and smaller than the first width so that the heads pass through the first opening portions of the slots, the locking key being movable relative to the first and second electrical connector modules to a locked position in which the shafts of the first and second tabs move into the second opening portion of the slots and the heads engage the insulative bodies of the first and second electrical connector modules to couple the first and second electrical connector modules together.

2. The apparatus of claim 1, wherein each of the heads of the first and second tabs include a base having a width substantially equal to the first width of the first portion of the slots.

3. The apparatus of claim 1, wherein a face of the locking key is formed to abut a face of the first electrical connector module and a face of the second electrical connector module when the first and second tabs engage the first and second electrical connector modules.

4. The apparatus of claim 3, wherein the face of the locking key is formed to include a channel configured to surround at least one ridge formed on the face of the first electrical connector module and at least one ridge formed on the face of the second electrical connector module.

5. The apparatus of claim 1, wherein the insulative body of each of the first and second electrical connector modules is formed to include at least two slots, and the locking key is formed to include a third tab configured to enter a second slot in the first module to engage the insulative body of the first electrical connector module and a fourth tab configured to enter a second slot in the second electrical connector module to engage the insulative body of the second electrical connector module.

6. The apparatus of claim 1, wherein the locking key is formed to include third and fourth tabs configured to enter two slots of a second electrical connector module and fifth and sixth tabs configured to enter two slots of a third electrical connector module to secure the first, second and third electrical connector modules together.

7. The apparatus of claim 1, wherein the locking key is formed to perform a coding function for at least one of the first and second electrical connector modules.

8. The apparatus of claim 1, wherein the insulative body portion of the each of the first and second electrical connector modules includes a pair of coding slot tabs configured to define the first and second opening portions of the slots.

9. The apparatus of claim 8, wherein the coding slot tabs each include a top bevel to facilitate movement of the first and second tabs to the locked position.

10. The apparatus of claim 1, wherein the tab head is formed to include a bottom wall and an arcuate top wall.

11. The apparatus of claim 1, wherein the wall of the insulative body of each of the first and second electrical connector modules has a thickness, and wherein the shafts of the first and second tabs have a length substantially equal to the thickness of the walls.

* * * * *